United States Patent [19]

Onishi

[11] 4,334,399

[45] Jun. 15, 1982

[54] APPARATUS FOR TRANSFERRING STRIP-LIKE PLASTICS BAG MATERIAL IN PACKAGING MACHINE

[75] Inventor: Masami Onishi, Tokyo, Japan

[73] Assignee: Taiyo Shokai Co., Ltd., Japan

[21] Appl. No.: 150,369

[22] Filed: May 16, 1980

[30] Foreign Application Priority Data

May 17, 1979 [JP] Japan ..... 54-59668
Sep. 14, 1979 [JP] Japan ..... 54-118270

[51] Int. Cl.[3] ..... B65B 43/12

[52] U.S. Cl. ..... 53/69; 53/385; 53/459; 493/406

[58] Field of Search ..... 53/384–386, 53/69, 67, 75–76, 459, 457, 492; 493/406

[56] References Cited

U.S. PATENT DOCUMENTS 3,477,196 11/1969 Lerner ..... 53/459 X
3,754,370 8/1973 Hanson ..... 53/459
3,956,866 5/1976 Lattur ..... 53/459

FOREIGN PATENT DOCUMENTS 2746126 4/1978 Fed. Rep. of Germany ..... 53/459

*Primary Examiner*—James F. Coan
*Attorney, Agent, or Firm*—McGlew and Tuttle

[57] ABSTRACT

This invention provides an apparatus for transferring a strip-like plastic bag material in a packing machine. The apparatus comprises a pair of intermittently operated pinching rollers for intermittently transferring the bag material, said bag material comprising a series of interconnected bags each having a heat-sealed bottom portion with a flap-like margin, a mechanism for raising said flap-like margin during transfer of said bag material, a microswitch for detecting said bottom portion, said microswitch having an elongated contact adapted to be releasably engaged with said flap-like margin as said flap-like margin is raised during transfer of said bag material and means for stopping said bag material in response to detection by said microswitch of said bottom portion.

4 Claims, 9 Drawing Figures

APPARATUS FOR TRANSFERRING STRIP-LIKE PLASTICS BAG MATERIAL IN PACKAGING MACHINE

BACKGROUND OF THE INVENTION

The present invention relates generally to a packing machine of the type which is capable of intermittently conveying a strip-like bag material which comprises a series of interconnected plastic bags, packing desired goods into a foremost bag section of the strip-like bag material, thereafter heat-sealing the bag section and separating the sealed bag section from a subsequent bag section of the bag material, and more particularly, it relates to an apparatus for transferring such a bag material in such packing machine.

In general, the strip-like bag material as used in packing machines of the type described above is of the structure as illustrated in FIGS. 1 and 2. The strip-like bag material A shown in these figures is made of a collapsed film tube of a thermoplastic synthetic resin, such as vinyl or polyethylene, which is manufactured by an extruder with an inflation device, and comprises a series of interconnected bags 6. The strip-like bag material A is provided with a plurality of transversely extending rectilinear welded portions 2 which form bottoms of the respective bags 6 and which are formed by heat-sealing the bag material transversely across the same at regular intervals by a heat-sealer. Also, the bag material A is provided, in one side thereof, with transversely extending rectilinear opening portions 3 which are respectively located at portions adjacent to the respective welded portions 2 at regular intervals and in parallel relationship therewith, whereby flat-like margins 4 of the welded portions 2 are formed transversely across the bag material A between the opening portions 3 and the welded portions 2, respectively. Further, the bag material A is provided, on the other side thereof, with easily severable rectilinear fragile portions 5 which are formed across the breadth of said bag material on the other side thereof at portions opposite to the opening portions 3, respectively. In the illustrated embodiment, each of the rectilinear fragile portions 5 takes the form of a row of perforations formed in the other side.

Usually, packing operation with the use of the strip-like bag material A is performed as described below. First, the strip-like bag material A wound into the form of a roll as shown in FIG. 3 is supported on a roll support 13 of a packing machine P and then the leading end of the rolled bag material A is drawn. Thereafter, the bag material A is pinched between a pair of intermittently operated pinching rollers 8 after being passed over guide means 7*a* in such a way that its leading end depends from the pinching rollers 8 and leads to a goods-charging location 9 located beneath the same. Under this condition, the bag material A is conveyed, by actuating the pinching rollers 8, for a distance corresponding to the length l of one of said bags 6, then during inoperative interval of the rollers 8, the foremost bag 6 is inflated by actuating an air blower 10 so that goods 11 can be smoothly packed into the foremost bag 6 and then after the goods have been packed, operation of the blower 10 is stopped and the bag is sealed along its opening portion 3 by means of heat-sealers 12 and finally, the goods-charged bag 6 is separated from the subsequent bag 6 of the bag material A at the fragile portion 5 of the goods-charged bag. Thereafter, such packing operation is repeated by operating the pinching rollers 8.

To ensure intermittent transfer of the strip-like bag material A for a distance corresponding to the length of a single bag, two methods have hitherto been proposed. One of the methods employs a photoelectric detector and the other of the methods a pair of electrodes which is oppositely located on both sides of the bag material as a detecting means, respectively. The former may only be applied in case where printed patterns, letters, register marks or the like are indicated on the respective bag sections of the bag material, while the latter is applicable only in case where openings, cut-outs or the like are formed in the respective bag sections. In addition, the former has such drawbacks that when the bag material is transferred at a high speed, such register marks or the like cannot be accurately scanned by the photoelectric means, which causes the bag material to be transferred for a distance not corresponding to the length of a single bag of the bag material, thus causing not only inaccurate intermittent transfer of the bag material, but also incomplete or defective packing and that the provision of the photoelectric means requires a great expense. On the other hand, the latter method has also such additional drawbacks that the use of electrodes requires considerably high voltage which causes a danger of injuring operators and that the scanning capacity of the electrodes is considerably low.

SUMMARY OF THE INVENTION

The present invention is intended to eliminate the drawbacks and inconveniences indicated with the conventional methods and means in the art and to provide a new apparatus for transferring a strip-like plastics bag material which comprises a series of interconnected bags in a packing machine that is capable of accurately intermittently transferring such bag material for a distance at a time corresponding to the length of one of said bags, irrespective of the fact that the bag material has register marks, etc. or not and is transparent or not.

Another object of the present invention is to provide an apparatus of the character described above which does not require the provision of complicated or expensive detecting means, or both as is the case with conventional apparatuses.

A further object of the present invention is to provide an apparatus of the character described which is simple in structure and which can be manufactured and sold at a reasonable cost.

Other objects and advantageous features of the present invention will become apparent from the following description taken in conjunction with the accompanying drawings.

DESCRIPTION OF THE PREFERRED EMBODIMENT

Figure 1:
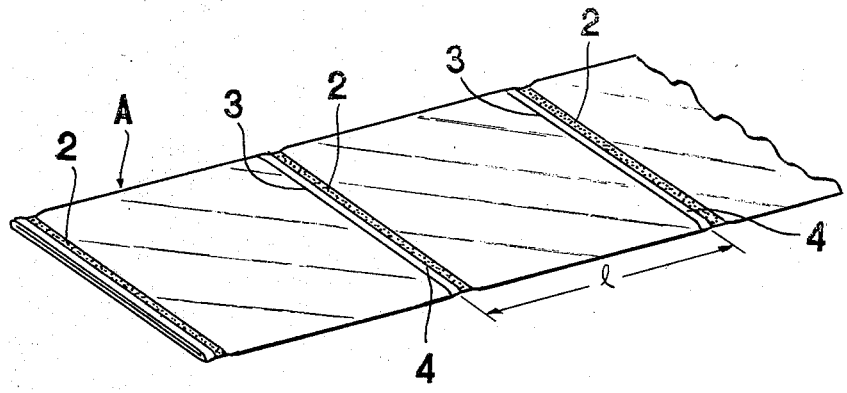
FIG. 1 is a fragmental perspective view of the strip-like bag material for use in the apparatus of the present invention.
Figure 2:
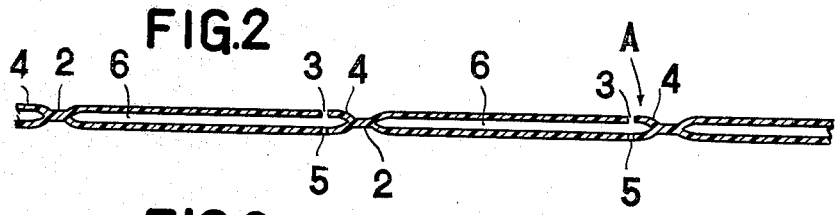
FIG. 2 is a vertical cross-sectional side view of the bag material shown in FIG. 1, taken along the longitudinal axis thereof.

Like portions or parts are indicated by like numerals and characters throughout the specification and drawings.

Referring now to the drawings, a guide means *7a* in the form of a roller or substantially V-shaped plate for guiding the bag material A is provided in the packing machine P. The guide means *7a* is located at an intermediate position of the travelling course of the strip-like bag material A that extends from the roll support 13 to the goods-charging location 9.

Figure 3:
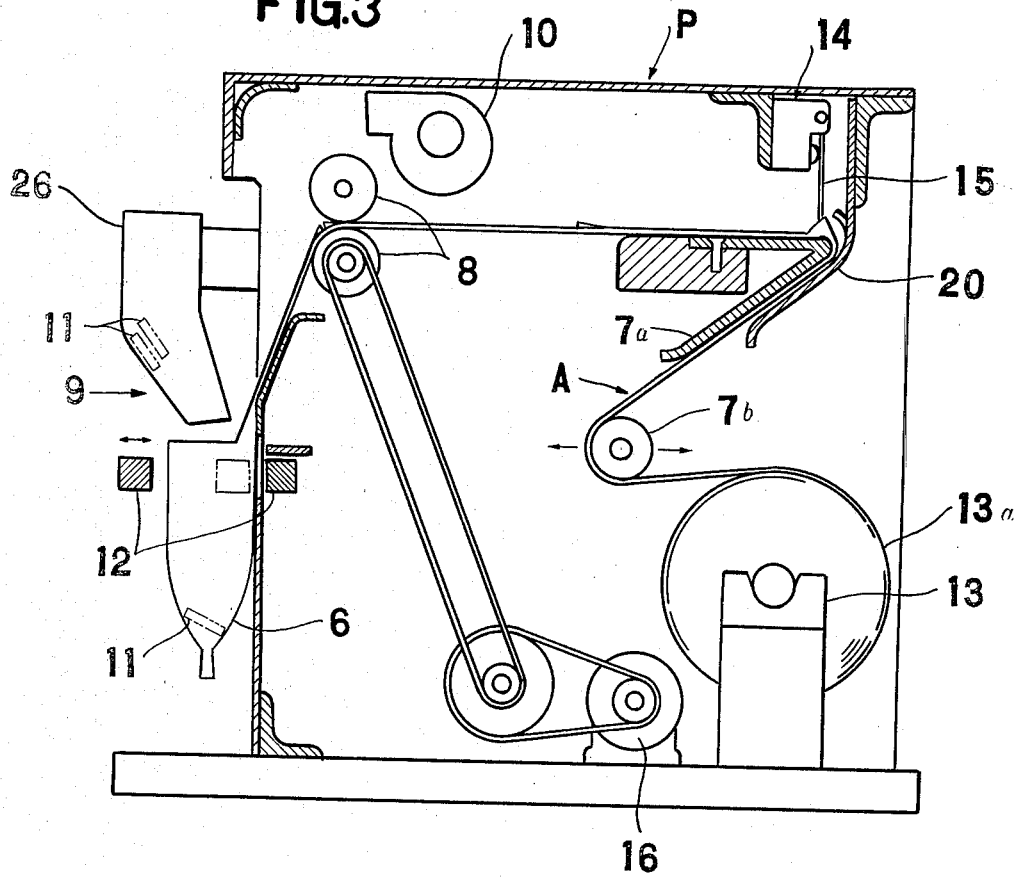
FIG. 3 is a schematic side view of a packing machine in which the apparatus of the present invention is incorporated.
Figure 4:
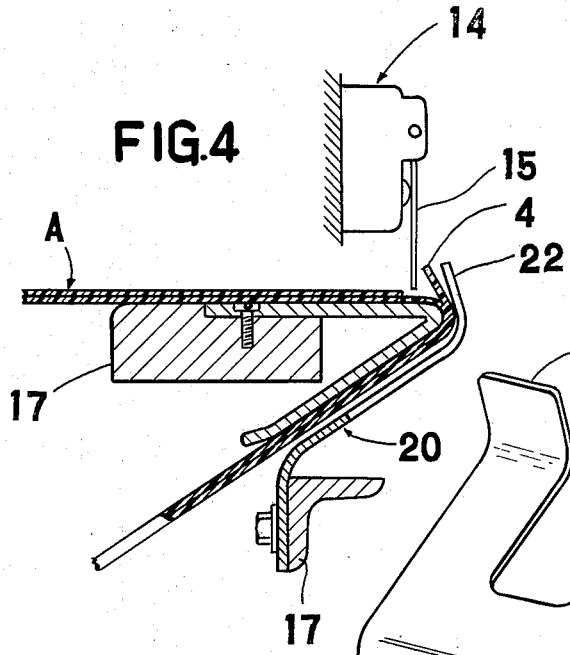
FIG. 4 is an enlarged schematic side view illustrating the state in which the microswitch as a detecting means is operated by the flap-like margin of the welded bottom portion of one of the bag sections of the bag material.
Figure 5:
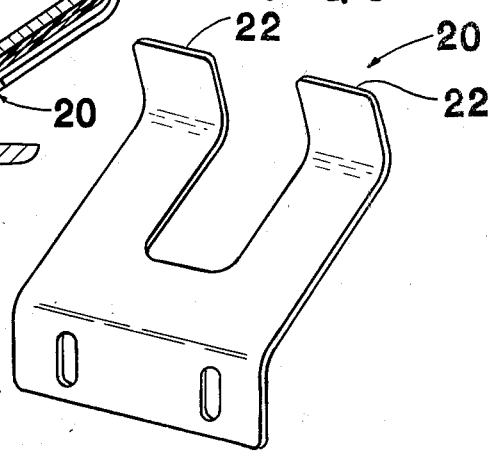
FIG. 5 is a perspective view of one form of means for smoothing the wrinkles formed in the bag material.
Figure 6:
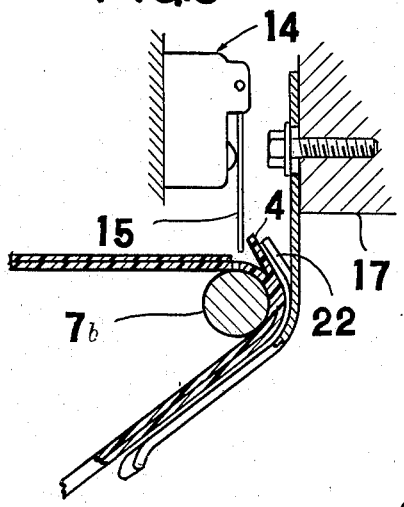
FIG. 6 is a view similar to the view shown in FIG. 4.
Figure 7:
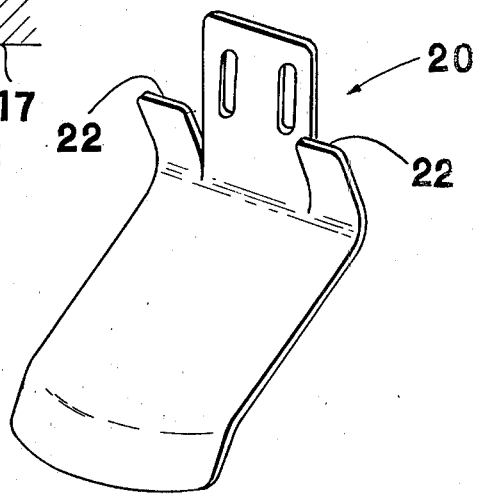
FIG. 7 is another form of means for smoothing said wrinkles.
Figure 8:
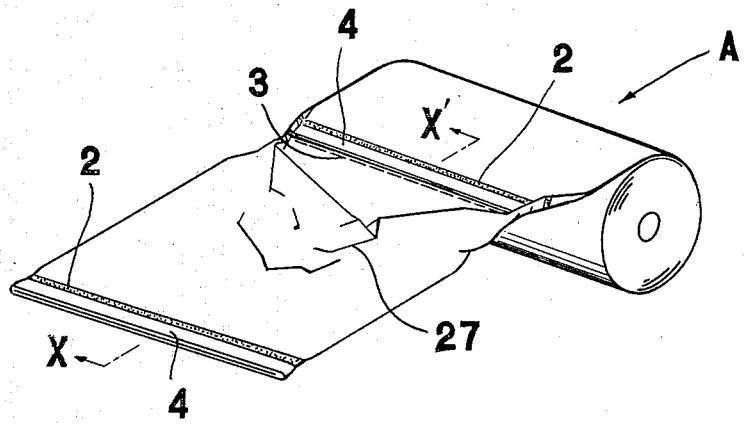
FIG. 8 is a perspective view of the rolled bag material in which wrinkles are formed.
Figure 9:
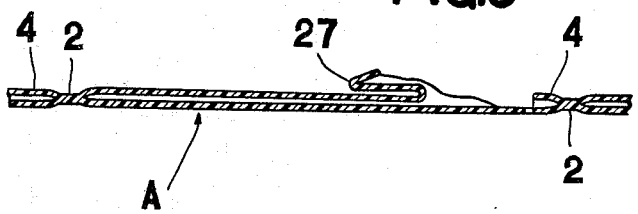
FIG. 9 is a cross-sectional view taken along X—X' line in FIG. 8.

As shown in FIGS. 3, 4 and 6, the guide means *7a* is mounted to carry thereon the bag material A such that each of the opening portions 3 of the respective bags 6 is directed outwardly of the guide means *7a* when passing over the same. Accordingly, the free end of a flap-like margin 4 is caused to be raised slightly above the surface of one side of the bag section as it travels over the guide means *7a*, as illustrated in FIGS. 3, 4 and 6.

In the vicinity of the guide means *7a*, there is provided a microswitch 14 having an elongated contact 15 which is arranged to be releasably engaged with the margin 4, as the latter passes over and is raised by the guide means *7a*. As the contact 15 engages the raised margin, the microswitch 14 is closed thereby and transmits a signal of detection of the welded portion 2 which forms the bottom of a bag 6.

As such signal is received by a control device, not shown, from the microswitch 14, rotation of a motor 16 for driving the pinching rollers 8 is stopped. In case where an electromagnetic clutch is incorporated between the motor 16 and the pinching rollers 8, said clutch is caused to be released in response to the signal to stop rotation of the rollers 8. In either case, as rotation of the rollers 8 is stopped, travel of the bag material A is also stopped.

Indicated by *7b* is an adjusting roller *7b* for adjusting the position of the leading end of the bag material A. By displacing the roller *7b* in the directions as indicated by arrows in FIG. 3, the bag section 6 located at the leading end of the bag material A can be exactly positioned at the goods-charging location 9.

As the bag material A is stopped in response to the detection of the bottom of a bag section 6 by the microswitch 14, sequential operations are performed by the packing machine P which comprise air blowing by the blower 10, charging goods into the expanded bag section, sealing the goods-charged bag section along the opening portion 3 by heat-sealers 12 and separating the sealed bag section from the subsequent bag section at the row of perforations 5. Then after completion of the above sequential operations, the pinching rollers 8 are driven again for the next packing operation.

Indicated by reference numeral 20 is a member for smoothing wrinkles 27 formed in the bag material A. This member 20 is secured to the frame 17 of the machine P such that it extends along the outer curved face of the guide means *7a* so as to allow the bag material A to pass through between said face and said member. Preferably, the clearance between the two members *7a* and 20 is such that the wrinkles 27 are smoothed by frictional contact with the latter member 20. The wrinkle-smoothing member 20 is provided, at the bag material-discharging side thereof, with forked portions 22 which are located in the vicinity of both sides of the elongated contact 15 of the microswitch 15, respectively. Thus, although wrinkles 27 tends to be formed in the bag material A when the latter is wound by a reel *13a*, such wrinkles 27 can be smoothed during travel of the bag material A prior to passing through the location of the microswitch 14 and accordingly, there is no possibility that the microswitch 14 is caused to be unexpectedly operated. In FIG. 3, reference numeral 26 indicates a hopper for charging goods into the bag 6 inflated by the air blower 10.

As may be seen from the foregoing, in accordance with the apparatus of the present invention, detection of travel of the bag material A for a distance corresponding to the length of a single bag 6 can be mechanically effected by engagement of the contact 15 of the microswitch 14 with the flap-like margin 4 of the welded portion 2, that is to say, the flap-like margin of the welded portion which forms a connection between two adjacent bag sections is automatically detected by means of an inexpensive microswitch each time when the strip-like bag material is conveyed and accordingly, automatic control of intermittent transfer of the bag material for a predetermined distance is accurately performed, even if the bag material has neither register marks and the like nor openings for detection.

What I claim is:

1. An apparatus for conveying an elongated strip-like bag material of a collapsed plastic film tube in a packing machine, said bag material being of the type having a series of interconnected bags each having on one side thereof a transversely extending heat-sealed bottom portion and a transversely extending opposite opening portion located at a portion adjacent to and parallel with said heat-sealed portion, each bag of said material having a flap-like margin formed transversely across the bag material between said opening portion and said heat-sealed portion and also an easily severable fragile portion formed transversely across the bag material on the other side thereof at a portion opposite to said opening portion, the packing machine being of the type having goods-charging means for charging goods into the bags, and the material being mounted in a roll, said apparatus comprising a pair of intermittently operated pinching rollers for intermittently conveying said bag material extending from the roll of said bag material for a distance, at a time, corresponding to the length of a single bag towards the goods-charging device of said packing machine, guide means mounted upstream of said pinching rollers for guiding said bag material through a travel path, said guide means having a curved surface for carrying said bag material so that respective opening portion of the bag material is directed outwardly of said guide means and said flap-like margin is caused to be raised when passing over said curved surface, detecting means for detecting said flap-like margin, said detecting means comprising a microswitch having an elongated contact mounted adjacent the curved surface of said guide means and arranged to be releasably engageable with said margin responsive to the raising of said margin during travel of said bag material, means for stopping travel of said bag material for sequential packing operations in response to detection by said microswitch of said flap-like portion, and means for smoothing wrinkles formed in said bag-material, said smoothing means comprising a plate mounted adjacent said guide means and upstream of said microswitch to form a passage between said guide means and said plate for allowing said bag material to pass therethrough, said passage having a clearance capable of smoothing said wrinkles as said bag material travels through said passage.

2. The apparatus as set forth in claim 1, wherein said guide means comprises a plate having a V-shaped cross-section having a first leg and a second leg from which said first leg is depended and wherein the plate of said means for smoothing said wrinkles extends along the outer face of said first leg so that said wrinkles can be smoothed prior to passing through the location of said microswitch.

3. The apparatus as set forth in claim 1, wherein said guide means is a guide roller.

4. The apparatus as set forth in claim 2 or 3, wherein said plate of said wrinkle-smoothing means is provided, at the bag material-discharging side thereof, with a pair of forked portions curved along the curved surface of said guide means so that said wrinkles are kept smoothed before passing over said curved surface.

* * * * *